US005725166A

United States Patent [19]

Nakayama et al.

[11] Patent Number: 5,725,166

[45] Date of Patent: Mar. 10, 1998

[54] SWING TYPE CRUSHER

[75] Inventors: Hiroshi Nakayama, Chiba; Koichiro Ogushi, Saga, both of Japan

[73] Assignee: Nakayama Iron Works, Ltd., Takeo, Japan

[21] Appl. No.: 580,621

[22] Filed: Dec. 29, 1995

[30] Foreign Application Priority Data

Nov. 10, 1995 [JP] Japan ..... 7-317173

[51] Int. Cl.[6] ..... B02C 1/02

[52] U.S. Cl. ..... 241/259.1; 241/267

[58] Field of Search ..... 241/259.1, 259.2, 241/264–269, 286

[56] References Cited

U.S. PATENT DOCUMENTS

| | | | |
|---|---|---|---|
| 264,179 | 9/1882 | Marsden | 241/268 |
| 419,294 | 1/1890 | Spiers et al. | 241/269 |
| 1,029,910 | 6/1912 | Buchanan | 241/269 |
| 3,326,479 | 6/1967 | Connolly et al. | 241/268 |
| 3,656,696 | 4/1972 | Mailliard | 241/268 X |
| 4,765,546 | 8/1988 | Stewart | 241/268 X |
| 5,397,069 | 3/1995 | Kitsukawa et al. | 241/267 |

FOREIGN PATENT DOCUMENTS

| | | |
|---|---|---|
| 363415 | 5/1900 | Belgium . |
| 1218492 | 5/1960 | France . |
| 267338 | 8/1911 | Germany . |
| 274729 | 2/1912 | Germany . |
| 805030 | 11/1958 | United Kingdom . |

*Primary Examiner*—Mark Rosenbaum

*Attorney, Agent, or Firm*—Armstrong, Westerman, Hattori, McLeland & Naughton

[57] ABSTRACT

A swing type crusher capable of efficiently breaking a non-rigid object into pieces of small particle size. A jaw crusher breaks a lump of asphalt cast into a V-shaped crushing space (V) which is defined between a fixed tooth plate (26) and a movable tooth plate (25), and which periodically changes its volumetric capacity. A toggle plate (12) is interposed between a body (1) and the movable tooth plate (25) to swingably support the movable tooth plate (25). A support member (9) which swingably supports the body-side end portion of the toggle plate (12) is vertically movably secured to the body (1). By vertically moving the support member (9), the spacing between the fixed tooth plate (26) and the movable tooth plate (25) is narrowed (widened), and at the same time, the stroke of the movable tooth plate (25) is reduced, thereby efficiently breaking a non-rigid object, e.g. waste asphalt, into small pieces, and reusing them immediately.

8 Claims, 8 Drawing Sheets

SWING TYPE CRUSHER

BACKGROUND OF THE INVENTION

The present invention relates to a jaw crusher, that is, an eccentric rotation or swing type crusher, in which a movable tooth plate and a fixed tooth plate define a crushing space that is under at an upper end portion thereof and narrower at a lower end portion thereof, and the movable tooth plate swings relative to the fixed tooth plate. More particularly, the present invention relates to a jaw crusher, that is, a crusher of the concerned type, which is capable of adjusting the size of crushed particles, based on the relationship between the stroke of motion of the lower end portion of the movable tooth plate, that moves relative to the fixed tooth plate, and the width of the lower end portion of the crushing space.

Swing type crushers, called "jaw crushers", are known and used as machines for crushing rocks, asphalt pavement wastes, concrete scraps, etc. into pieces of desired size. Such a swing type crusher is arranged as follows: Materials to be crushed are thrown into a V-shaped crushing space defined between two plate-shaped teeth, which includes, a fixed tooth plate and a movable tooth plate, from above it, and the materials are inserted between the fixed tooth plate and the movable tooth plate, one of which swings relative to the other, and are crushed by the stresses concentrated at three points. Pieces of the crushed materials are again crushed to be formed as materials of smaller particle size, for example, aggregate, which is then discharged below the machine from a narrow gap at the lower end of the V-shaped crushing space.

Hitherto, this type of crusher has mainly been used to break raw stone of high hardness into stones of smaller particle size. It is a common practice to adjust the hardness and the particular size of raw stone crushed to obtain an intermediate product. Such adjustment is made by a device for moving a defined portion of the body which swingably supports a body-side end portion of a swing support member for supporting the swinging tooth plate, wherein the body-side end is located against the body. Such a conventional moving device is adapted to move the body-side defined portion only in a horizontal direction. It has heretofore been conceived that crushing can be performed in various modes with regard to the particle size and hardness of raw stones or materials by using the above-described moving device.

It has been desired from the viewpoint of global environmental protection that asphalt pavement wastes should be crushed to a smaller size and instantly recycled as aggregates. It has been revealed that an experiment or a test to crush such non-rigid materials by a conventional crusher results in that a lump of crushed asphalt is thermally deformed and sticks to the fixed and movable tooth plates, causing the crushing efficiency to reduce rapidly. Crushers, which were provided from the beginning of development to crush materials of high hardness, cannot cope with the demand for crushing non-rigid materials by using the conventional adjusting device. That is, it has been found that, according to the adjusting device of the conventional crusher, if the body-side defined portion is transferred in a direction in which the lower end portion of the crushing space narrows, the stroke increases, thereby the crusher becomes suitable for breaking a non-rigid object, but, on the other hand, sticking of the non-rigid object is likely to occur, and the crushing efficiency drastically reduces. Further, such transfer is not able to allow the particle size to be reduced to a small value. A machine which is capable of reducing the likelihood of sticking of a non-rigid object while increasing the stroke is demanded at a site where the same machine is desired to be used for crushing various materials having their respective hardnesses without changing dimensions, such as the eccentricity, the length of the swing member, etc.

At a construction site where asphalt is broken and reused as aggregates, it is desirable that one crusher can break not only a non-rigid object but also a rigid object. At such a site, it is desired that a single crusher should serve for crushing both non-rigid and rigid objects, without the need of preparing a crusher or crushers for a non-rigid object and another crusher for a rigid object at the same time.

SUMMARY OF THE INVENTION

The present invention was invented on the above mentioned background arts and the following objects are provided.

An object of the present invention is to provide a swing type crusher capable of crushing a non-rigid object into pieces of small particle size.

Another object of the present invention is to provide a swing type crusher capable of highly efficiently crushing a non-rigid object into pieces of small particle size.

Still another object of the present invention is to provide a swing type crusher having a simple structure for highly efficiently crushing a non-rigid object into pieces of small particle size.

A further object of the present invention is to provide a swing type crusher having a simple structure in which a swing support member is simply moved in a vertical direction for highly efficiently crushing a non-rigid material into pieces of small particle size.

A still further object of the present invention is to provide a swing type crusher capable of freely coping with a desired crushing mode.

The swing type crusher according to the present invention operates as follows: In the swing type crusher according to the present invention, a non-rigid material for crushing is held between the fixed tooth plate and the movable tooth plate in the lower end portion of the crushing space and crushed or broken by the action of the movable tooth plate, which swings with a small stroke relative to the fixed tooth plate. When the stroke is smaller, the width of the lower end portion of the crushing space, which is defined between the fixed and movable tooth plates, is narrower. Thus, the non-rigid object is efficiently broken into pieces of small particle size. By moving the fixed position at which the swing support means is fixed in both vertical and horizontal directions, rigid rock can be broken into pieces of large particle size with a large stroke as in the conventional practice. Further, it is possible by use of the some crusher to carry out crushing in various modes which are different in the hardness of a material object to be crushed and the particle size of pieces into which an object of crushing is crushed. In general, the dimensions of the machine are dynamically changed at a site, coping flexibly or freely with a desired crushing mode regarding the object of crushing, ambient temperature and other external environments, particle size, etc. Directions of rotations, i.e. a normal direction of rotation of an eccentric shaft and a reverse direction of rotation thereof, strongly relate to the efficiency with respect to the respective positions of the body size-defined portions in a vertical direction.

BRIEF DESCRIPTION OF THE DRAWINGS

The above and other objects, features and advantages of the present invention will become more apparent from the following description of the preferred embodiments according to the present invention, referring to the accompanying drawings, in which like reference numerals denote like elements, and of which.

DETAILED DESCRIPTION OF THE PREFERRED EMBODIMENTS

Embodiments of the present invention will be described below with reference to the accompanying drawings.

(First Embodiment)

Figure 1:
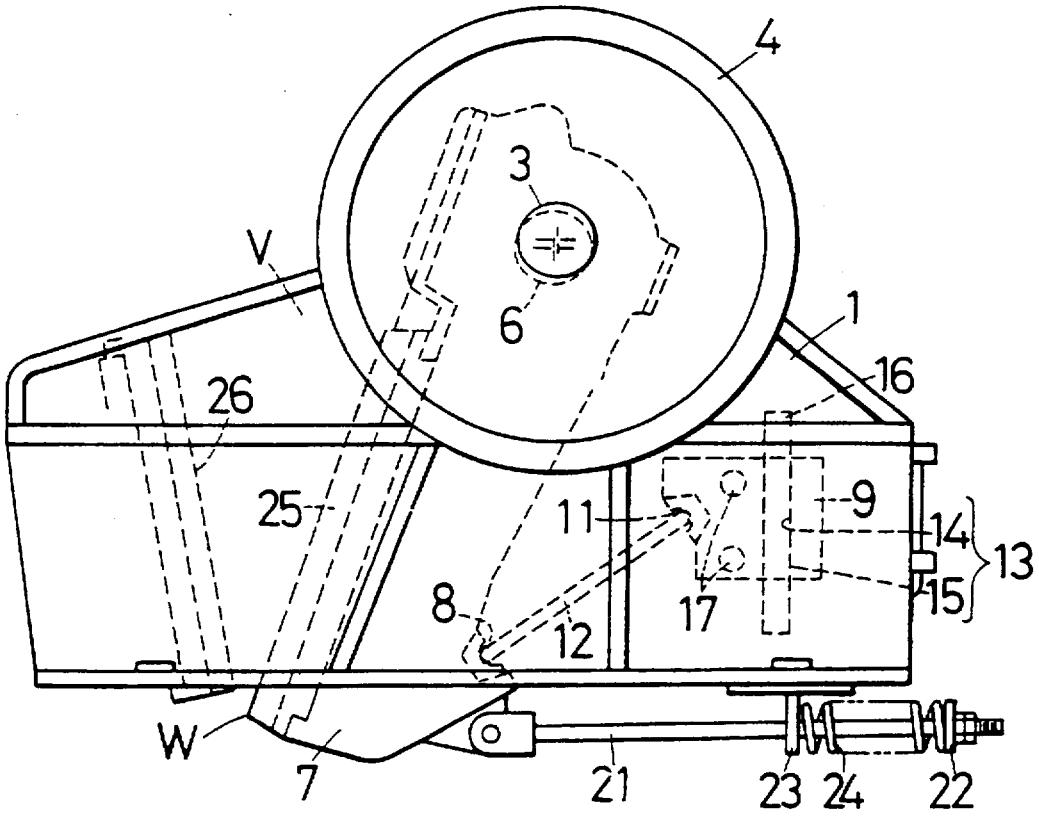
FIG. 1 is a front view of a first embodiment of the swing type crusher according to the present invention.
Figure 2:
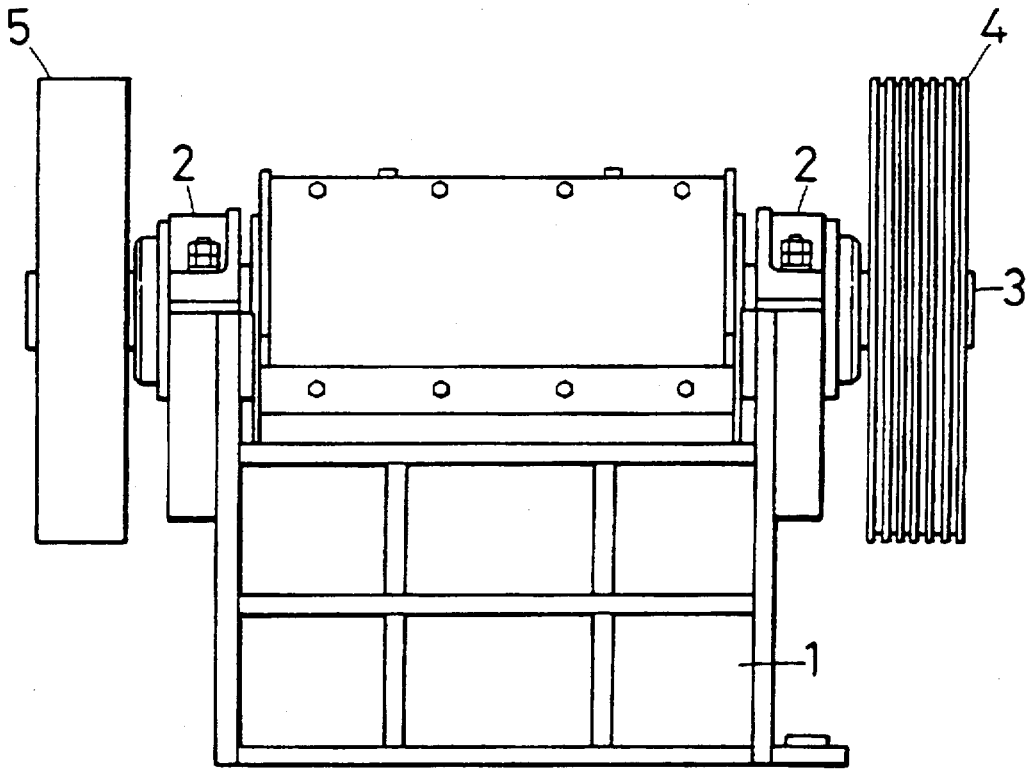
FIG. 2 is a side view of the embodiment shown in FIG. 1.

FIGS. 1 and 2 show a first embodiment of a swing type crusher according to the present invention, a crusher of this type being hereinafter referred to as a "jaw crusher". The jaw crusher has a robust body 1 that is made of steel plate.

The body 1 is provided with two bearings 2. A driving shaft 3 is rotatably supported by the bearings 2. A driving wheel 4 and a driving flywheel 5 are attached to two ends, respectively, of the driving shaft 3. The driving shaft 3 and the driving wheel 4 are driven by an oil-hydraulic motor (not shown).

An eccentric rotating shaft 6 is eccentrically mounted on a rotating member (not shown) which rotates together with the driving shaft 3 as one unit. The upper end portion of a swing jaw 7, which is a swing member, is attached to and rotatably supported by the eccentric rotating shaft 6. A device for eccentrically rotatably supporting the upper end portion of the swing member includes the eccentric rotating shaft 6 and the body 1.

The rear side (right-hand side as shown in FIG. 1) of the lower end portion of the swing jaw 7 is provided with a jaw-side recess 8. The jaw-side recess 8, which is formed on the rear side of the swing jaw 7, forms and defines a first defined portion as a portion of the swing jaw 7, the defined portion being defined as a constant portion relatively fixed on the coordinate system fixed on the swing jaw 7. A toggle block 9 is mounted on the body 1. The body 1 includes the toggle block 9 which is a portion thereof.

The toggle block 9 is provided with a block-side recess 11 which faces diagonally opposite the jaw-side recess 8. The block-side recess 11 forms a second defined portion as a portion of the body 1, the defined portion being defined as a constant portion relatively fixed on the coordinate system fixed on the body 1. A toggle plate 12 as a swing support member is mounted between the recess 8 of the swing jaw 7 and the recess 11 of the toggle block 9.

The jaw-side recess 8, the block-side recess 11, and the toggle plate 12 extend parallel to the axial direction of the driving shaft 3. The toggle plate 12 has a rectangular shape. One end of the toggle plate 12 is swingably engaged with the jaw-side recess 8. The other end of the toggle plate 12 is swingably engaged with the block-side recess 11. The toggle block 9 has a vertically extending guide groove 13.

The guide groove 13 has left and right vertical surfaces 14 and 15 which are parallel to each other in the axial direction of the driving shaft 3. A guide member 16 which extends through the guide groove 13 is vertically fixed to the body 1. The left and right sides of the guide member 16 slide on the two vertical surfaces 14 and 15, respectively, of the guide groove 13. The toggle block 9 is secured to the body 1 by a plurality of bolts 17 at an arbitrary vertical position.

A tension rod 21 is swingably connected to the lower end of the swing jaw 7. A compression coil spring 24 is provided between a collar 22 attached to the rear end of the tension rod 21 and a spring retainer 23 which is secured to the body 1 so that the tension rod 21 extends through the spring retainer 23. A movable tooth plate 25 which is in the form of a flat plate is secured to the front side of the swing jaw 7.

A fixed tooth plate 26 which is also in the form of a flat plate is secured to a slightly inclined wall surface inside the body 1 in opposing relation to the movable tooth plate 25. The fixed tooth plate 26 is set at an acute angle with respect to the movable tooth plate 25 to define therebetween a crushing space V with a V-shaped cross-sectional configuration for breaking an object of crushing which is raw stone or other material. The crushing space V extends along the axial direction of the driving shaft 3.

The jaw crusher generally has the following positional relationship: The second defined portion 11 lies below the eccentric rotation supporting device, which includes the driving shaft 3 and other associated members. A vertical line that passes through the first defined portion 8 lies between a vertical line passing through the second defined portion 11 and a vertical line passing through the lower end portion of the fixed tooth plate 26. The second defined portion 11 is movably secured to the body 1. The direction of movement of the second defined portion 11 is a direction in which the width of the lower end portion of the crushing space V narrows and, at the same time, the stroke of the lower end portion of the movable tooth plate 25, which defines the lower end portion of the crushing space V, reduces.

(Operation of the First Embodiment)

Next, the operation of the first embodiment will be explained. As the driving shaft 3 is driven to rotate, the eccentric rotating shaft 6 revolves around the driving shaft 3. Consequently, a portion of the swing jaw 7 which is adjacent the jaw-side recess 8 performs a circular motion centered at the block-side recess 11, causing the swing jaw 7 to swing. The lower end portion of the movable tooth plate 25, which is secured to the swing jaw 7, moves in an elliptic path. At this time, the lower end portion of the movable tooth plate 25 performs an approximately rectilinear reciprocating motion relative to the fixed tooth plate 26 in an oblique direction (for more details, see U.S. Pat. No. 5,397,069. The upper end portion of the movable tooth plate 25 performs an even more elliptic motion. An object of crushing, for example, raw stone of high hardness, is cast into the crushing space V from above it.

A large object to be crushed is held between the fixed tooth plate 26 and the movable tooth plate 25 at three points in principle in the upper portion of the V-shaped crushing space V, which is defined between the fixed and movable tooth plates 26 and 25. Thus, stresses concentrated on the three points cause the object to be crushed. A plurality of materials broken into pieces of relatively small size in the upper portion of the crushing space V fall into a middle portion of the crushing space V. In the middle portion of the crushing space V, the materials are subjected to similar crushing force to break into pieces of smaller size. In the lower portion of the crushing space V, the materials are further broken into pieces of still smaller particle size. In this way, materials of desired size are produced.

Figure 3:
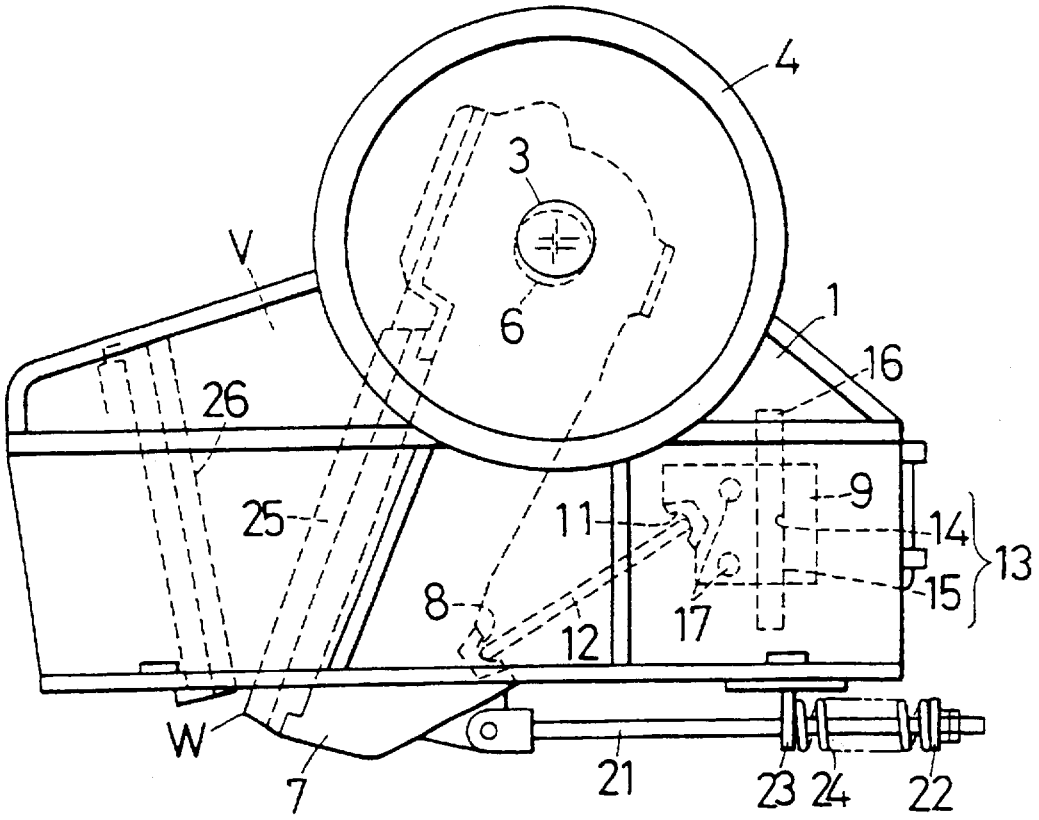
FIG. 3 is a front view of the embodiment shown in FIG. 1 in a state where a part of the swing type crusher has been operated.
Figure 4:
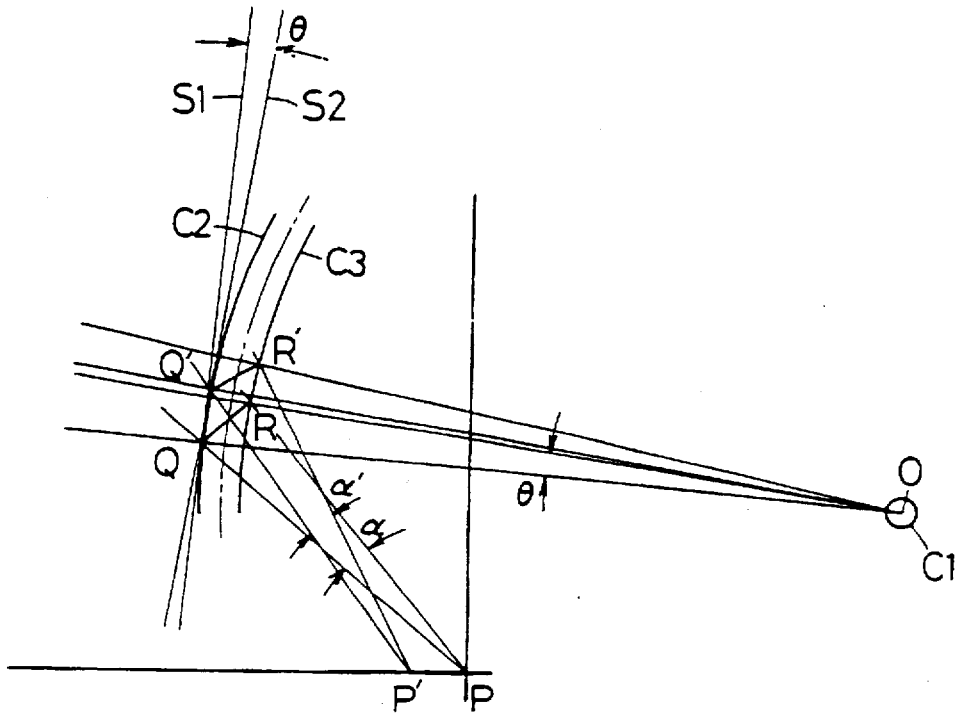
FIG. 4 is a geometrical figure for analysis of the operation of the first embodiment.

When a non-rigid object, for example, asphalt pavement waste, is to be broken, the bolts 17 are untightened, and the toggle block 9 is moved vertically downward on the guide member 16 and resecured to the body 1 at a lower position by retightening the bolts 17 (see FIG. 3). FIG. 4 is a geometrical figure for analysis of the stroke of the movable tooth plate 25 before and after the movement of the position of the toggle block 9.

A moving point on the upper end portion of the swing jaw 7 defines a small eccentric circle C1. The center of the circle C1 is represented by O. The point or line of contact between the block-side recess 11 and the toggle plate 12, shown in FIG. 1, is represented by the point P. The point or line of contact between the jaw-side recess 8 and the toggle plate 12, shown in FIG. 1, is represented by the point Q. A circular arc C2 is defined with its center at the center of the circle C1 and with a radius determined by adding the eccentricity (the radius of the circle C1) to the distance between the center of the circle C1 and the contact point Q. Further, a circular arc C3 is defined with its center at the center of the circle C1 and with a radius determined by subtracting the eccentricity (the radius of the circle C1) from the distance between the center of the circle C1 and the contact point Q.

The intersection between the arc C3 and an arc having its center at the point P and with a radius equal to the length PQ (the length of the toggle plate 12; hereinafter represented by L) is assumed to be R. A point which is vertically downward apart from the point P by a relatively short distance is represented by P'. A circular arc is drawn with its center at the point P' and with a radius L, and the intersections between this arc and the arc C2 and C3 are represented by Q' and R', respectively. Lines tangent to the arc C2 at the points Q and Q' are represented by S1 and S2, respectively. It is assumed that the angle QOQ'=the angle $\theta$=the intersectional angle between the tangent lines S1 and S2, and that the intersection angle between the straight lines PQ and P'Q' is $\beta$.

When the center O is sufficiently distant from the point Q in comparison to the point P (in an actual ordinary crusher, the length QO is more than twice the length QP), the angle $\beta$ can be made larger than the angle $\theta$ by moving the point P' vertically downward through only a slight distance from the point P. The angle between the straight lines QR and PQ is close to a right angle. The angle between the straight lines Q'R' and P'Q' is also close to a right angle. Therefore, the angle between the straight line QR and the tangent line S1 and the angle between the straight line Q'R' and the tangent line S2 are approximately equal to each other. Accordingly, the angles at which the straight lines QR and Q'R', respectively intersect the zone between the circles C2 and C3 are equal to each other to a good approximation.

As will be understood from the drawing, the length Q'R' is shorter than the length QR. Assuming that the angle QPR is $\alpha$, and the angle Q'P'R' is $\alpha'$, $\alpha'$ is smaller than $\alpha$. Assuming that the distance between the point P and a specific point W (shown in FIG. 1) on the swing jaw 7 when the toggle block 9 is in the position shown in FIG. 1 is k, the stroke of the point W in the state shown in FIG. 1 can be approximated by $k\alpha$, while the stroke of the point W in the state shown in FIG. 3 can be approximated by $k\alpha'$.

Thus, the stroke of the point W is reduced by moving the point P vertically downward through only a slight distance to the point P'. In FIG. 4, if the point P is moved to the point P', the stroke of the point W reduces, and at the same time, the lower end portion of the crushing space V narrows. Thus, if the toggle block 9 is moved through an appropriate distance, the lower end portion of the crushing space V narrows, and the average particle size of broken material reduces.

The change of the stroke reduces the likelihood of sticking of a non-rigid object to the movable and fixed tooth plates 25 and 26. Conversely, to break a rigid object into relatively large pieces, the toggle block 9 is moved vertically upward. It has experimentally been confirmed that the above-described crushing method makes it possible to improve the production efficiency in crushing of a non-rigid object such as asphalt.

(Second Embodiment)

Figure 5:
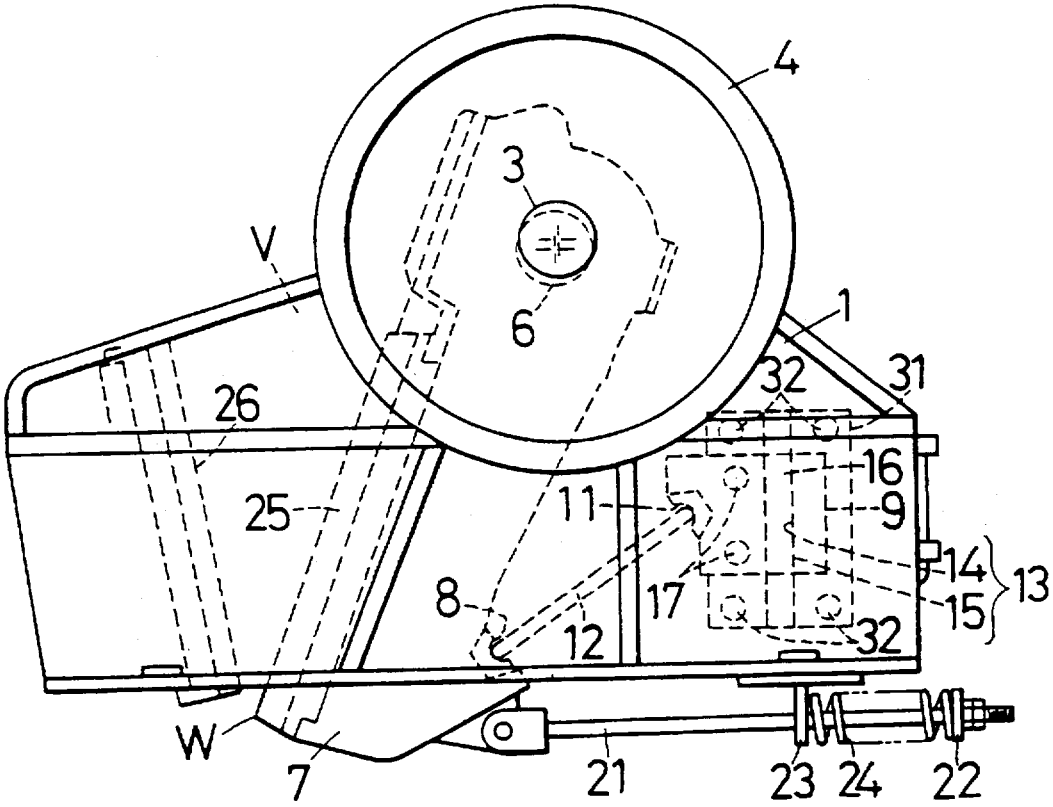
FIG. 5 is a front view of a second embodiment of the swing type crusher according to the present invention.

Next, a second embodiment according to the present invention will be described with reference to FIG. 5. A side view of this embodiment is similar to FIG. 2, illustration thereof being omitted. The jaw crusher includes a body 1, and the body 1 is provided with two bearings 2. A driving shaft 3 is supported by the bearings 2. A driving wheel 4 and a driving flywheel 5 are attached to two ends, respectively, of the driving shaft 3. An eccentric rotating shaft 6 is eccentrically attached to a rotating member (not shown) which rotates together with the driving shaft 3 as one unit. The upper end portion of a swing jaw 7, which is a swing member, is attached to and rotatably supported by the eccentric rotating shaft 6. The rear side (right-hand side as viewed in FIG. 5) of the lower end portion of the swing jaw 7 is provided with a jaw-side recess 8 which forms a first defined portion as a portion of the swing jaw 7, the defined portion being fixed on the swing jaw 7. The body 1 is provided with a toggle block 9 which forms a second defined portion as a portion of the body 1, the defined portion being fixed on the body 1. The toggle block 9 is provided with a block-side recess 11 which faces diagonally opposite the jaw-side recess 8. A toggle plate 12 as a swing support member is mounted between the jaw-side recess 8 and the body-side recess 11.

This embodiment is also the same as the first embodiment in the following points: The jaw-side recess 8, the block-side recess 11, and the toggle plate 12 extend along the axial direction of the driving shaft 3. The toggle plate 12 has a rectangular shape. One end of the toggle plate 12 is swingably engaged with the jaw-side recess 8. The other end of the toggle plate 12 is swingably engaged with the block-side recess 11.

The toggle block 9 has a vertically extending guide groove 13. The guide groove 13 has left and right vertical surfaces 14 and 15 which are parallel to each other in the axial direction of the driving shaft 3. A guide member 16 which extends through the guide groove 13 is vertically mounted on a horizontally movable member 31. The left and right sides of the guide member 16 slide on the two vertical surfaces 14 and 15, respectively, of the guide groove 13. The toggle block 9 is secured to the horizontally movable member 31 by a plurality of bolts 17 at an arbitrary vertical position.

The horizontally movable member 31, which is not provided in the first embodiment, is horizontally movable and firmly secured to the body 1 at a selected position by a plurality of bolts 32. In the same way as in the first embodiment, a tension rod 21 is swingably attached to the lower end of the swing jaw 7. A compression coil spring 24 is provided between a collar 22 attached to the rear end of the tension rod 21 and a spring retainer 23 which is secured to the body 1 so that the tension rod 21 extends through the spring retainer 23. A movable tooth plate 25 which is in the form of a flat plate is secured to the front side of the swing jaw 7. A fixed tooth plate 26 which is also in the form of a flat plate is secured to a slightly inclined wall surface inside the body 1 in opposing relation to the movable tooth plate 25. The fixed tooth plate 26 is set at an acute angle to the movable tooth plate 25 to define therebetween a crushing space V with a V-shaped cross-sectional configuration for breaking an object of crushing which is raw stone or other material. The crushing space V extends along in the axial direction of the driving shaft 3.

In the crusher of the second embodiment also, the second defined portion 11 lies below the eccentric rotation supporting device, which includes the driving shaft 3 and other associated members. A vertical line that passes through the first defined portion 8 lies between a vertical line passing through the second defined portion 11 and a vertical line passing through the lower end portion of the fixed tooth plate 26. The second defined portion 11 is movably secured to the body 1. The direction of movement of the second defined portion 11 is a direction in which the width of the lower end portion of the crushing space V narrows and, at the same time, the stroke of the lower end portion of the movable tooth plate 25, which defines the lower end portion of the crushing space V, reduces, in the same way as in the crusher of the first embodiment. However, the crusher of the second embodiment differs from the first embodiment in that the toggle block 9 is movable also in a horizontal direction.

(Operation of Second Embodiment)

Next, the operation of the second embodiment will be explained. The operation of this embodiment is the same as that of the first embodiment in the following point: As the driving shaft 3 is driven to rotate, the eccentric rotating shaft 6 revolves around the driving shaft 3. Consequently, a portion of the swing jaw 7 which is adjacent the jaw-side recess 8 performs a circular motion centered at the block-side recess 11, causing the swing jaw 7 to swing. The lower end portion of the movable tooth plate 25, which is secured to the swing jaw 7, moves drawing an elliptic locus. At this time, the lower end portion of the movable tooth plate 25 performs an approximately rectilinear reciprocating motion relative to the fixed tooth plate 26 in an oblique direction. As the distance from the lower end of the movable tooth plate 25 increases upward, the motion of the movable tooth plate 25 becomes more elliptical.

When a non-rigid object, for example, asphalt pavement waste, is to be broken, the bolts 17 are untightened, and the toggle block 9 is moved vertically downward on the guide member 16 and resecured to the horizontally movable member 31 at a lower position by retightening the bolts 17.

The operation of this embodiment is also the same as that of the first embodiment in the following point: As the toggle block 9 is moved downward, the lower end portion of the crushing space V narrows, and the average particle diameter of broken material reduces. Further, because of reduction of the stroke, the likelihood of sticking of a non-rigid object to the movable and fixed tooth plates 25 and the 26 is reduced. Conversely, in order to break a rigid object into relatively large pieces, the toggle block 9 is moved vertically upward.

To break raw stone or material of higher hardness into pieces of smaller particle size, the bolts 32 are untightened, and the horizontally movable member 31 is moved toward the fixed tooth plate 26 and then secured to body 1 by retightening the bolts 32 in the same as in the conventional crusher. The analysis made in regard to FIG. 4 is not always valid.

The relationship between the stroke and the angle of the V-shaped crushing space formed between the movable and fixed tooth plates 25 and 26 may be reverse to that in the analysis made in connection with FIG. 4, depending upon the distance and angle in positional relationship between the constituent members. In such a case, the toggle block 9 is moved in an arbitrary oblique direction. By adjusting the distance through which the toggle block 9 is moved in that direction, materials of various hardness can be efficiently broken into pieces having a particle size close to the desired one. Such adjustment is also made in order to extend the lifetime of the tooth plates 25 and 26.

(Third Embodiment)

Figure 6:
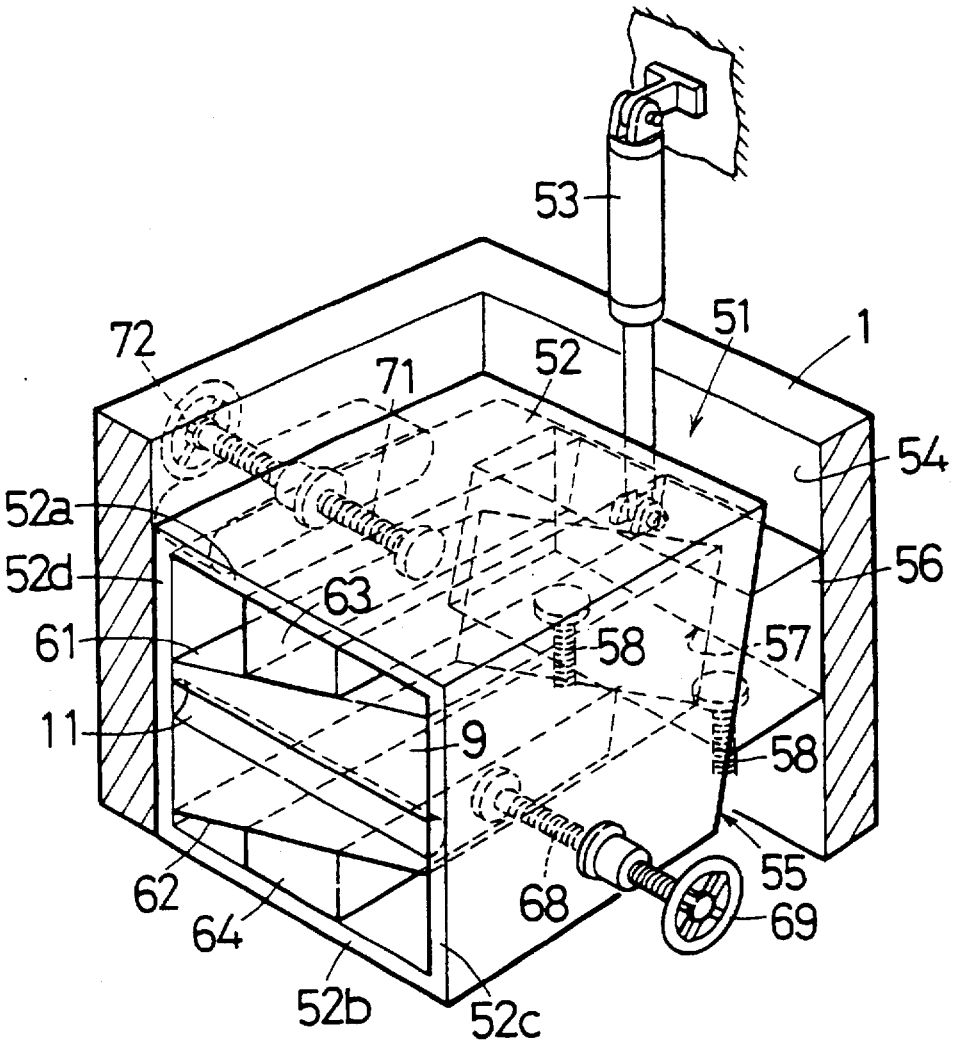
FIG. 6 is an oblique projection showing a third embodiment of the swing type crusher according to the present invention.
Figure 7:
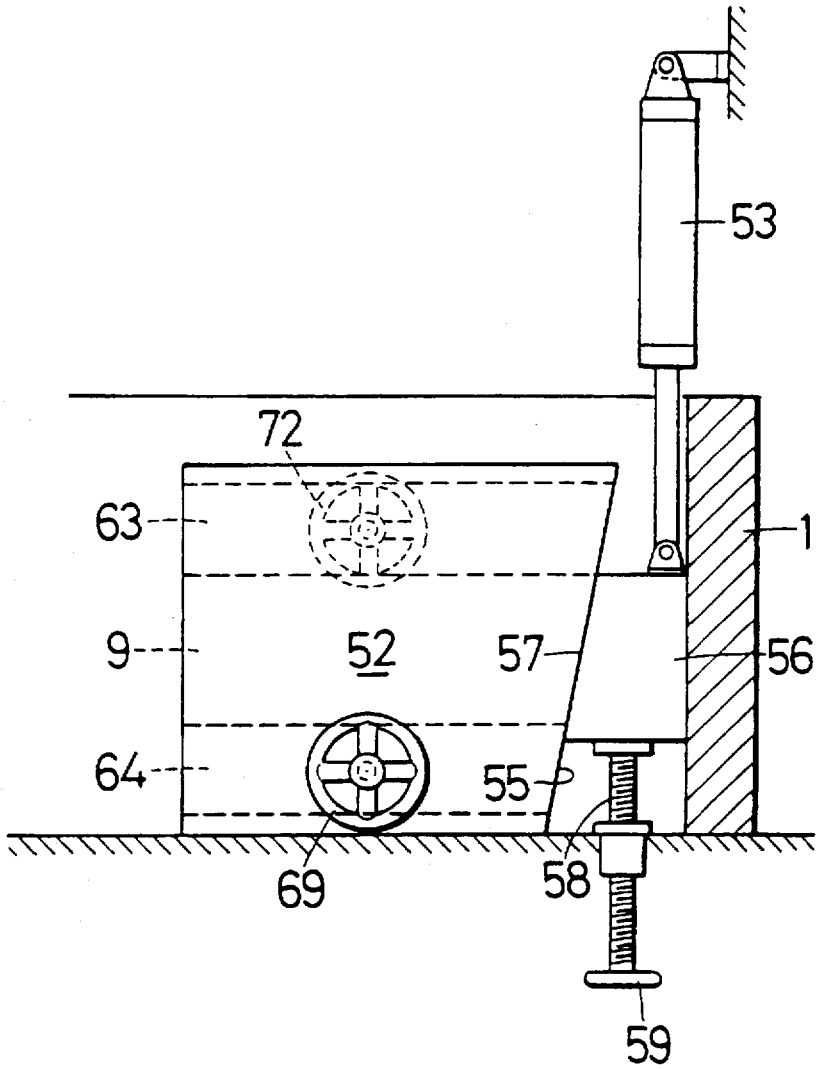
FIG. 7 is a sectional front view of the embodiment shown in FIG. 6.

FIGS. 6 and 7 are an oblique projection and a sectional front view, respectively, which show a third embodiment of the swing type crusher according to the present invention. The toggle block 9 in this embodiment has a reinforced structure. The toggle block 9 has a horizontal block-side recess (second defined portion) 11. A block guide structure 51 is held by the body 1 so as to be guided by the latter. The block guide structure 51 is provided with a horizontally movable member 52 (corresponding to the horizontally movable member 31 in the second embodiment).

The horizontally movable member 52 moves in a first direction. The horizontally moving member 52 is driven to move horizontally by a vertical oil-hydraulic cylinder 53. The vertical oil-hydraulic cylinder 53 is secured to the body 1 so as to be slightly pivotable. A first wedge 56 is interposed between a vertical surface 54 of a vertical wall of the body 1 and a rear end surface 55 of the horizontally moving member 52. The first wedge 56 has a slant surface 57 on the front thereof. The rear end surface 55 of the horizontally moving member 52 is a slant surface contacting the slant surface 57.

The block guide structure 51 has a hollow hexahedral configuration comprising parallel upper and lower walls **52*a* and 52*b* and parallel right and left walls 52*c* and 52*d*. The front and rear ends of the block guide structure 51 are open. The rear end surfaces of the four walls 52*a*, 52*b*, 52*c* and 52*d* form a slant surface that serves as the rear end surface 55 of the horizontally moving member 52. Vertical stop screws 58 are vertically engaged with the lower wall of the body 1**.

The vertical stop screws 58 are each vertically advanced and retracted with respect to the lower wall of the body 1 by turning a first handle 59 (see FIG. 7). The toggle block 9 is guided by the right and left walls **52*c* and 52*d* of the horizontally moving member 52. Vertical left and right side surfaces of the toggle block 9 slide on the respective inner surfaces of the right and left walls 52*c* and 52*d* of the horizontally moving member 52. Upper and lower surfaces 61 and 62 of the toggle block 9** are parallel slant surfaces.

The slant surfaces each have a small angle with respect to a horizontal plane. Accordingly, the toggle block 9 has a rhombic cross-sectional configuration. The front end surface of the toggle block 9 is provided with a second defined portion as a block-side recess 11. The block-side recess 11 extends horizontally.

An upper second wedge 63 is interposed between the lower surface of the upper wall 52*a* and the upper slant surface 61 of the toggle block 9. The width of the upper second wedge 63 is narrower than the width of the toggle block 9. A lower second wedge 64 is interposed between the upper surface of the lower wall 52*b* and the lower slant surface 62 of the toggle block 9. The width of the lower second wedge 64 is narrower than the width of the toggle block 9.

A lower horizontal stop screw 68 is horizontally engaged with the right wall 52*c*. The lower horizontal stop screw 68 is horizontally advanced and retracted with respect to the right wall 52*c* by turning a lower second handle 69. An upper horizontal stop screw 71 is horizontally engaged with the left wall 52*d*. The upper horizontal stop screw 71 is horizontally advanced and retracted with respect to the left wall 52*d* by turning an upper second handle 72.

(Operation of Third Embodiment)

If the first wedge 56 is pulled up by driving the vertical oil-hydraulic cylinder 53, the rear end surface 55 of the horizontally moving member 52 is pushed forward by the slant surface 57 of the first wedge 56, causing the horizontally moving member 52 to move forward. The vertical stop screws 58 are advanced so that the distal (upper) ends of the vertical stop screws 58 abut on the first wedge 56. By this operation, the first wedge 56 is set in a predetermined heightwise position.

By the above positioning operation, the horizontal advanced/retracted position of the horizontally moving member 52 is determined. As a result of setting the advanced/retracted position of the horizontally moving member 52, the advanced/retracted position of the toggle block 9 is set. Even if retracting force acts on the horizontally moving member 52, lowering of the first wedge 56 can be prevented with relatively weak stopping force of the vertical stop screws 58 by the wedge effect of the first wedge 56.

The lower second handle 69 and the upper second handle 72 are turned so that either one of the lower and upper horizontal stop screws 68 and 71 is retracted, while the other is advanced (the screws 68 and 71 are advanced or retracted in the same direction). Consequently, the upper second wedge 63 and the lower second wedge 64 move parallel to each other in the same direction. In this way, the upper and lower second wedges 63 and 64 are moved to respective predetermined positions.

The upper and lower wedges 63 and 64 thus moved are fixed at the respective positions. At the position where the upper and lower wedges 63 and 64 are fixed, the heightwise position of the toggle block 9 is determined, and the toggle block 9 is fixed at this position.

The above-described positioning of the toggle block 9 in two-dimensional directions can be safely carried out even during the operation of the crusher. Although strong force acts on the block-side recess 11, the toggle block 9 can resist force applied thereto from the toggle plate 12 in two-dimensional directions with relatively weak force by the wedge effect of the first wedge 56 and the pair of lower and upper second wedges 64 and 63.

(Other Embodiments)

That the correlation between the stroke of the movable tooth plate 25 and the width of the crushing space V is changed for adjustment by displacing a pivot point of the toggle plate 12 on a two-dimensional plane is mathematically equivalent to that the pivot points at both ends of the toggle plate 12 are moved relative to each other.

Figure 8:
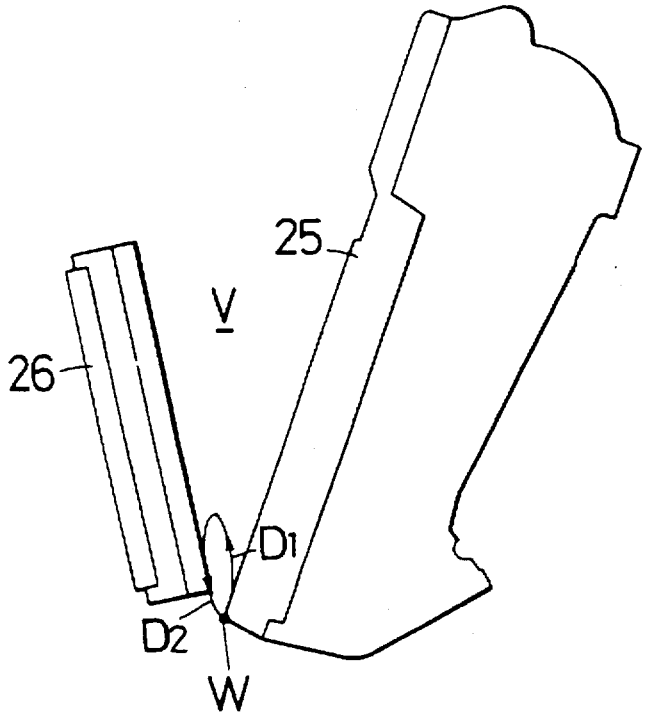
FIG. 8 is a front view showing a general locus of motion of a movable tooth plate in a swing type crusher.

The movable tooth plate of the jaw crusher performs a characteristic motion. The lower end point W (see FIG. 1) of the movable tooth plate draws a locus represented by a mathematical curve which is determined by the following parameters: the amount of eccentricity; the length of the toggle plate; the coordinates of the second defined portion; and the distance between the lower end point W of the movable tooth plate and the center of rotation of the movable tooth plate. Such a locus curve is, generally, elliptic. According to the literature, however, there are cases where the locus has a crescent shape or an approximately rectilinear shape. When the locus of motion has an elliptic shape as shown in FIG. 8, the direction of motion of the point W is counterclockwise. However, it has experimentally been found that, when a material to be broken is asphalt, weathered or other non-rigid rock, etc., the direction of motion of the point W is preferably the reverse direction, that is, the clockwise direction, from the viewpoint of the uniformity of particle size distribution, crushing efficiency, etc.

The swing type crusher of the present invention is operated with the rotation of the driving shaft 3 controlled to change between forward and backward directions. As shown in FIG. 8, the direction of motion of the point W, which moves on an ellipse, changes between the forward direction D1 and the backward direction D2. In the case of the backward direction D2, the object of crushing is pressed in such a manner as to be thrust up, thereby being broken. The rotational direction is changed according to the kind of object of crushing and the particle size distribution of pieces into which the object of crushing is to be broken. When an object of crushing is to be subjected to a crushing process including a plurality of steps in which primary crushing is carried out by forward rotation, and secondary crushing is carried out by backward rotation, thereby successively reducing the particle size, the crushing process can be carried out with a single crusher. Particularly, at a construction site into which many crushers cannot be carried, it may be necessary to bring in only one self-propelled jaw crusher capable of forward and backward rotation as described above.

Figure 9:
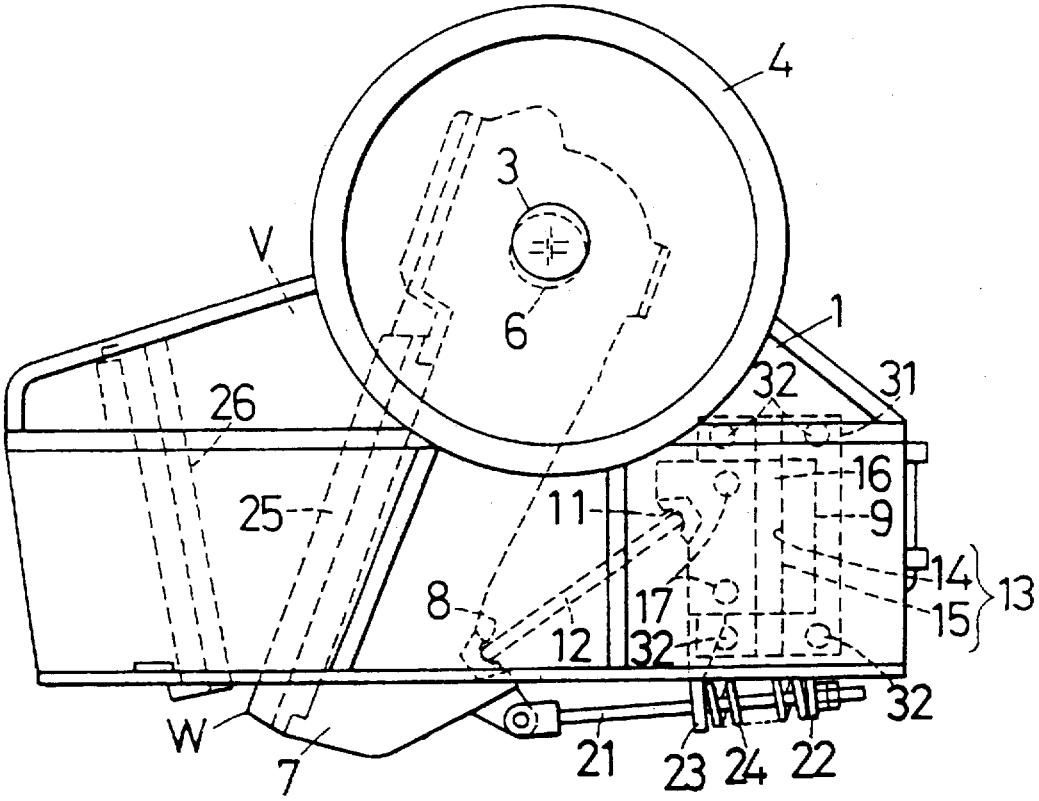
FIG. 9 is a front view showing another example of a tension rod support mechanism according to the present invention.

Further, as shown in FIG. 9, a support mechanism, which includes a collar 22 for resiliently supporting the rear end of a tension rod 21, a spring retainer 23, and a compression coil spring 24, may be integrally attached to the toggle block 9. By doing so, the support mechanism can be moved in accordance with the position of the toggle block 9.

The present invention provides the following advantageous effects: The mode of crushing can be adjusted, as desired, by moving the body-side fixed part only in a horizontal direction or in one rectilinear direction. By arranging the system such that the body-side fixed part can be moved vertically, it is possible to break a non-rigid object into pieces having a particle size which has heretofore been impossible to attain. In a crusher of the type in which a central point of eccentric rotation and central points of swing motion are disposed on a two-dimensional plane with dimensional relation to each other, one central point of swing motion is made movable on the same two-dimensional plane. Accordingly, the relationship between the width of the crushing space and the stroke of the movable tooth plate can be adjusted, as desired, and thus a product of desired particle size can be efficiently produced according to the hardness of a raw material to be broken. The two-dimensional moving mechanism using wedges as constituent elements is robust.

Although the present invention has been described through specific terms, it should be noted here that the described embodiments are not necessarily exclusive and that various changes and modifications may be imparted thereto without departing from the scope of the invention which is limited solely by the appended claims.

What is claimed is:

1. A swing type crusher comprising:

a body;

a fixed tooth plate secured to said body;

a swing member adapted to swing relative to said fixed tooth plate;

a movable tooth plate secured to said swing member;

eccentric rotation support means provided on said body for eccentrically rotatably supporting an upper end portion of said swing member to move said movable tooth plate such that a point disposed at a lower portion thereof moves in a closed loop;

swing support means for swingably supporting said swing member while swinging, said swing support means being swingably engaged at one end with a first defined portion on said swing member and at the other end thereof with a second defined portion on said body and comprising a rigid plate extending between said first defined portion of said swing member and said second defined portion of said body so that a distance between said two ends is kept constant;

said fixed tooth plate and said movable tooth plate defining a crushing space which is narrow at a lower end portion thereof and wide at an upper end portion thereof, and in which a material to be broken is cast and crushed;

said second defined portion lying below said eccentric rotation support means, said first defined portion lying such that a vertical line passing through said first defined portion lies between a vertical line passing through said second defined portion and a vertical line passing through a lower end portion of said fixed tooth plate;

said second defined portion being movably secured to said body;

said second defined portion being movable in a direction in which a width of the lower end portion of said crushing space narrows, and at the same time, a stroke of a lower end portion of said movable tooth plate reduces; and means for driving said eccentric rotation support means selectively in opposite, forward and backward directions whereby, by rotation of said eccentric rotation support means in one direction, cooperation of said movable tooth plate on said swing member with said fixed tooth plate on said body facilitates crushing of materials of high hardness and, by rotation of said eccentric rotation support means in the opposite direction, effects a different cooperation between said tooth plates that facilitate crushing of non-rigid materials.

2. A swing type crusher according to claim 1, wherein said direction of movement of said second defined portion is a vertical direction.

3. A swing type crusher according to claim 1, wherein said direction of movement of said second defined portion has a vertical component and a horizontal component.

4. A swing type crusher according to claim 1, wherein a mechanism for moving said second defined portion has a block guide structure which is secured to said body, said block guide structure including a first wedge movable in a first direction, and a toggle block having a rhombic cross-sectional configuration, said second defined portion being provided on said toggle block, said toggle block being caused to move in a second direction by movement of said wedge in said first direction.

5. A swing type crusher according to claim 4, wherein said block guide structure is secured to said body so as to be movable in a third direction, said block guide structure being positioned with respect to said body through a second wedge, said block guide structure being caused to move in said third direction by movement of said second wedge in a fourth direction.

6. A swing type crusher according to claim 5, wherein said first wedge and said second wedge each have means for securing it to said body.

7. A swing type crusher comprising:

a body;

a fixed tooth plate secured to said body;

a swing member adapted to swing relative to said fixed tooth plate;

a movable tooth plate secured to said swing member;

eccentric rotation support means provided on said body for eccentrically rotatably supporting an upper end portion of said swing member to move said movable tooth plate such that a point disposed at a lower portion thereof moves in a closed loop;

swing support means for swingably supporting said swing member while swinging, said swing support means being swingably engaged at one end thereof with a first defined portion on said swing member and at the other end thereof with a second defined portion on said body and comprising a rigid plate extending between said first defined portion of said swing member and said second defined portion of said body so that a distance between said two ends is kept constant;

said fixed tooth plate and said movable tooth plate defining a crushing space which is narrow at a lower end portion thereof and wide at an upper end portion thereof, and in which a material to be broken is cast and crushed;

said second defined portion lying below said eccentric rotation support means, said first defined portion lying such that a vertical line passing through said first defined portion lies between a vertical line passing through said second defined portion and a vertical line passing through a lower end portion of said fixed tooth plate;

said second defined portion being movably secured to said body;

said second defined portion being movable in a direction which has two independent direction components relative to said first defined portion;

means for driving said eccentric rotation support means selectively in opposite, forward and backward directions whereby, by rotation of said eccentric rotation support means in one direction, cooperation of said movable tooth plate on said swing member with said fixed tooth plate on said body facilitates crushing of materials of high hardness and, by rotation of said eccentric rotation support means in the opposite direction, effects a different cooperation between said tooth plates that facilitates crushing of non-rigid materials.

8. A swing type crusher according to claim 7, wherein said first defined portion is movable on said swing member.

* * * * *